US010837736B2

(12) United States Patent
Marelin

(10) Patent No.: US 10,837,736 B2
(45) Date of Patent: Nov. 17, 2020

(54) HANDGUN WITH GUNSIGHT AUGMENTATION AND ENHANCED PISTOL-GRIP AND METHODS OF USE

(71) Applicant: MIKLOS DESIGN LLC, Aurora, CO (US)

(72) Inventor: Miklos B. Marelin, Aurora, CO (US)

(73) Assignee: Miklos Design LLC, Aurora, CO (US)

( * ) Notice: Subject to any disclaimer, the term of this patent is extended or adjusted under 35 U.S.C. 154(b) by 0 days.

(21) Appl. No.: 16/603,761

(22) PCT Filed: Mar. 29, 2019

(86) PCT No.: PCT/US2019/025029

§ 371 (c)(1),
(2) Date: Oct. 8, 2019

(87) PCT Pub. No.: WO2020/131149

PCT Pub. Date: Jun. 25, 2020

(65) Prior Publication Data

US 2020/0292274 A1 Sep. 17, 2020

Related U.S. Application Data

(60) Provisional application No. 62/781,047, filed on Dec. 18, 2018, provisional application No. 62/795,958, filed on Jan. 23, 2019.

(51) Int. Cl.
*F41G 1/01* (2006.01)
*F41G 1/34* (2006.01)
(Continued)

(52) U.S. Cl.
CPC ..... *F41G 1/01* (2013.01); *F41A 3/66* (2013.01); *F41C 3/00* (2013.01); *F41C 23/10* (2013.01); *F41G 1/345* (2013.01)

(58) Field of Classification Search
CPC ..... F41G 1/02; F41G 1/04; F41G 1/06; F41G 1/065; F41G 1/10; F41G 1/32; F41G 1/35; F41G 1/01; F41G 1/345
See application file for complete search history.

(56) References Cited

U.S. PATENT DOCUMENTS 3,777,380 A 12/1973 Theodore
4,244,114 A * 1/1981 Strahan ..... F41G 1/425 42/137

(Continued)

OTHER PUBLICATIONS

International Search Report for PCT/US2019/025029 from KIPO International Searching Authority, dated Aug. 29, 2019 (3 pages).

(Continued)

*Primary Examiner* — Stephen Johnson
(74) *Attorney, Agent, or Firm* — Terrance M. Wyles, Esq.; Startup IP Law, LLC

(57) ABSTRACT

The inventive disclosures pertain to an improved handgun (and related retrofit/after-market kits) that incorporates an improved gunsight and ergonomically enhanced pistol-grip member. In embodiments, an elongated gunsight-augmentation member is adapted to be inserted between a handgun's existing rear and front gunsights such that the gunsight has been basically transformed into a barrel-length U-shaped channel that makes it clear to a user how to line-up a target, while ensuring that the entire length of the device has a smooth shape and edges to significantly reduce snagging when drawing the firearm. The gunsight-augmentation member can also incorporate an internal fiber-optic rod as a visual aid to line-up a firearm. In variations, the improved handgun incorporates an ergonomically enhanced finger-receiving member disposed at the bottom surface of the pistol-grip and/or magazine that is especially useful for compact handgun designs.

37 Claims, 14 Drawing Sheets

(51) Int. Cl.

| | |
|---|---|
| ***F41C 23/10*** | (2006.01) |
| ***F41A 3/66*** | (2006.01) |
| ***F41C 3/00*** | (2006.01) |

(56) References Cited

U.S. PATENT DOCUMENTS

| | | | | |
|---|---|---|---|---|
| 4,651,432 | A * | 3/1987 | Bornancini | F41C 3/14 42/133 |
| 4,663,878 | A * | 5/1987 | Beretta | F41C 33/08 42/148 |
| 4,918,823 | A | 4/1990 | Santiago | |
| 5,878,503 | A | 3/1999 | Howe et al. | |
| 5,954,507 | A * | 9/1999 | Rod | F41G 3/2611 42/84 |
| 6,446,377 | B1 * | 9/2002 | Hollenbach | F41G 1/32 42/132 |
| 8,245,433 | B1 | 8/2012 | Smith | |
| 8,919,027 | B2 | 12/2014 | Curry | |
| D746,406 | S | 12/2015 | DeFelice | |
| 9,562,743 | B1 | 2/2017 | Mansfield | |
| 9,658,030 | B1 | 5/2017 | Heacock | |
| 10,006,740 | B1 | 6/2018 | Keller | |
| 10,101,121 | B2 | 10/2018 | Cabrera et al. | |
| 10,107,589 | B2 | 10/2018 | Neuhaus | |
| 2002/0029506 | A1 | 3/2002 | Wollmann | |
| 2004/0107621 | A1 * | 6/2004 | Segalle | F41C 23/16 42/71.02 |
| 2006/0123687 | A1 | 6/2006 | Howe et al. | |
| 2008/0134561 | A1 * | 6/2008 | Clouser | F41G 1/42 42/113 |
| 2011/0107650 | A1 | 5/2011 | Howe et al. | |
| 2016/0327366 | A1 | 11/2016 | Campean | |

OTHER PUBLICATIONS

Written Opinion from International Searching Authority for PCT/US2019/025029 from KIPO International Preliminary Examination Authority, dated Aug. 29, 2019 (7 pages).

"The Weakest Link—A good aiming system is a sight to behold.", Tamara Keel, Shooting Illustrated, Dec. 25, 2018, pp. 34-35; and "Sight Story" Reader Letter Commenting on the Dec. 2018 Shooting Illustrated Article "The Weakest Link—A good aiming system is a sight to behold." by Tamara Keel, Daniel E. Waters via Shooting Illustrated.com, Feb. 2019, p. 8.

* cited by examiner

HANDGUN WITH GUNSIGHT AUGMENTATION AND ENHANCED PISTOL-GRIP AND METHODS OF USE

CROSS-REFERENCE TO RELATED APPLICATIONS

This patent application has common Inventorship with, and claims the priority benefit of, U.S. Patent Application No. 62/781,047, filed on Dec. 18, 2018 for "Improved gun sight firearm aiming apparatus and magazine grip". In addition, this patent application has common Inventorship with, and claims the priority benefit of, U.S. Patent Application No. 62/795,958, filed on Jan. 23, 2019 for "Improved fiber optic gun sight." Further, this patent application hereby incorporates by reference U.S. Patent Application No. 62/781,047 and U.S. Patent Application No. 62/795,958 for all purposes. Should any irreconcilable conflicts arise between this patent application and the teachings of U.S. Patent Application No. 62/781,047 and/or U.S. Patent Application No. 62/795,958 for purposes of claim construction/interpretation, then this patent application's teaching shall govern.

BACKGROUND

Typically, handguns used for self-defense are compact, with focus on reduced weight and size, and are meant for short-range accuracy. In self-defense situations, when quick-drawing a handgun, it is especially important that that intent is not impeded by having part of the gun snag on clothing or holster. However, compact firearms and most handguns in general employ protruding gunsights, both at the front and rear of the gun barrel, for aiming the firearm. A common complaint by handgun owners and enthusiasts is that such gun sights present a problem because the gunsights can snag on clothing, holsters, etc. when attempting to draw from a holster or other means of firearm carrying. This is especially a problem for those who hold "conceal-carry" permits for their firearms. For example, see "The Weakest Link—A good aiming system is a sight to behold.", Tamara Keel, *Shooting Illustrated*, December 2018, Pgs. 34-35; and see also "Sight Story" Reader Letter Commenting on the December 2018 Shooting Illustrated Article "The Weakest Link—A good aiming system is a sight to behold." By Tamara Keel, Daniel E. Waters via *Shooting Illustrated.com*, February 2019, Pg. 8.

Moreover, the traditionally used protruding front gunsight may cover, in part or in whole, the intended target, and can be confusing for a novice (and/or a person under stress trying to use a firearm in an emergent situation) who is trying to properly aim a firearm, as the firearm user tries to properly line-up the rear and front gunsights. Often, novices require extensive training and explanation to use such traditional gunsights.

Protruding gunsights are often adjustable, typically at the rear sight, and their robustness to be held in place are dependent on the manufacturer's process; therefore, such gunsights may get knocked out of alignment if the firearm is dropped or bumped in the right way.

In addition, the handgrips/pistol-grips of most compact handguns are sized and oriented such that they lack an ergonomically well-defined place for the user's pinky (fifth digit) finger, which in turn interferes with comfort and thus effectiveness of a firearm user. In addition, for some handguns that use magazine cartridges inserted into the handgun's pistol-grip, some magazines can be inadvertently ejected (due to a combination of user stress, vibration, and/or improperly placed magazine-release mechanisms, which is typically a spring-loaded button disposed on the pistol grip that can be inadvertently pressed) such that they fall vertically from within the pistol-grip.

What is needed is an improved handgun that addresses the gunsight issues discussed above as well as that addresses the ergonomic deficiencies of the handles of many handguns. Related to this, what is also needed are retrofit kits for existing handguns that address the above-stated deficiencies in typical handgun design.

BRIEF SUMMARY

The inventive disclosures described herein pertain to an improved handgun (and related retrofit/after-market kits) that incorporates an improved gunsight and ergonomically enhanced pistol-grip member. In many embodiments, the improved handgun includes a gunsight-augmentation member that is adapted to be inserted between the handgun's rear and front gunsights such that the gunsight has been basically transformed into a barrel-length U-shaped channel that makes it clear to a user how to line-up a target, while ensuring that the entire length of the device has a smooth shape and edges to significantly reduce snagging when drawing the firearm. In variations, the gunsight-augmentation member includes an opening for the discharge of ammunition shells as the firearm is discharged. In other variations, the gunsight-augmentation member also incorporates a channel that receives a fiber-optic rod, wherein one end of the fiber-optic rod is visible from the rear-end of the gunsight-augmentation member via a short tunnel leading to the end of the fiber-optic rod, and wherein the gunsight-augmentation member has one or more light-gathering openings along the length of the gunsight-augmentation member. When a user is looking at the rear of the gunsight fully in-line with the gun barrel, then the end of the fiber-optic rod, which can be of just about any color (e.g., fluorescent green, red, yellow, orange, etc.), will appear illuminated, thus informing the user that the user has the gunsight/barrel fully lined-up with the user's line of sight.

In some embodiments, the improved handgun also incorporates an ergonomically enhanced finger-receiving member disposed at the bottom surface of the pistol-grip and/or magazine. The ergonomically enhanced finger-receiving member allows a user to have a more-comfortable and secure grip of a handgun, as it provides a secure position of the user's pinky (fifth digit) finger, especially for compact handguns. In addition, the ergonomically enhanced finger-receiving member, when disposed at the bottom of a handgun's magazine, helps prevent the inadvertent disengagement and loss of the handgun's magazine during use.

The above-stated improvements can be applied to many, if not most, handgun designs. However, certain handguns that employ a toggle-lock action (such as with a German Luger pistol), as opposed to a slide action employed by most semi-automatic pistols, would not be candidates for retrofitting with the above-stated gunsight-augmentation members.

The foregoing Brief Summary is intended to merely provide a short, general overview of the inventive disclosure described throughout this patent application, and therefore, is not intended to limit the scope of the inventive disclosure contained throughout the balance of this patent application, including any appended claims and drawings.

DETAILED DESCRIPTION

I. Overview

Figure 1A:
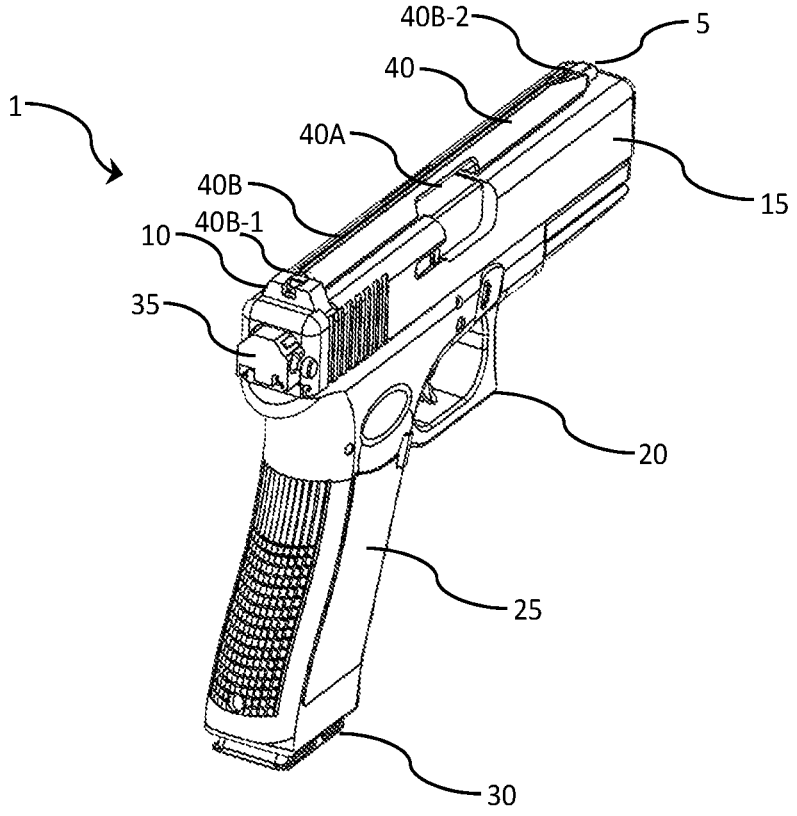
FIG. 1A depicts one embodiment of a right-top-rear isometric view of an improved handgun featuring a gunsight-augmentation member.
Figure 1B:
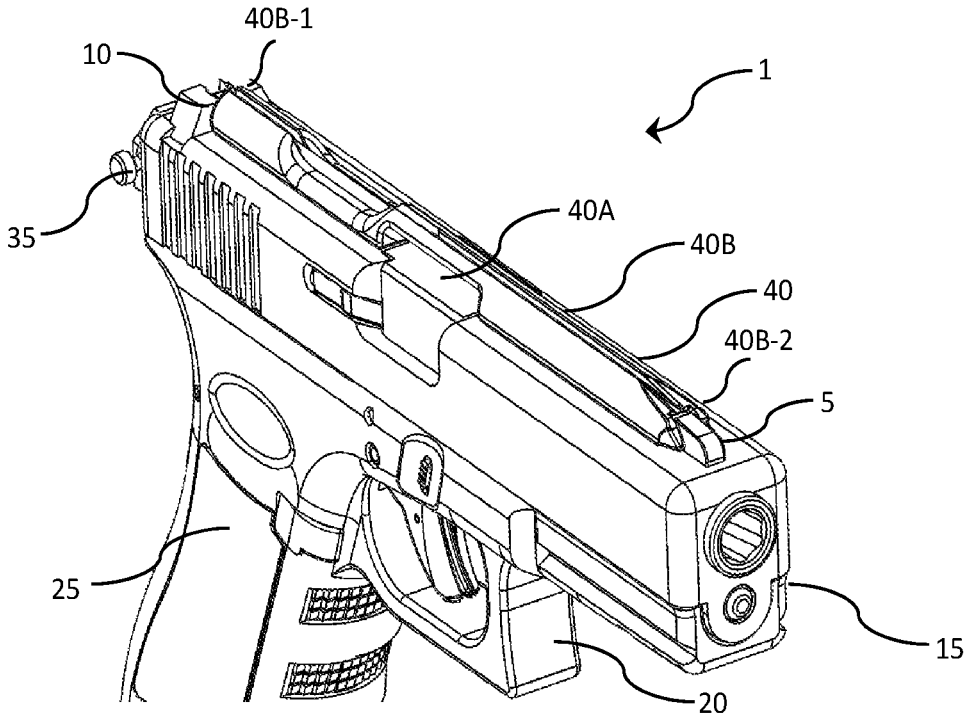
FIG. 1B depicts one embodiment of a right-top-front isometric view of an improved handgun featuring a gunsight-augmentation member.
Figure 2A:
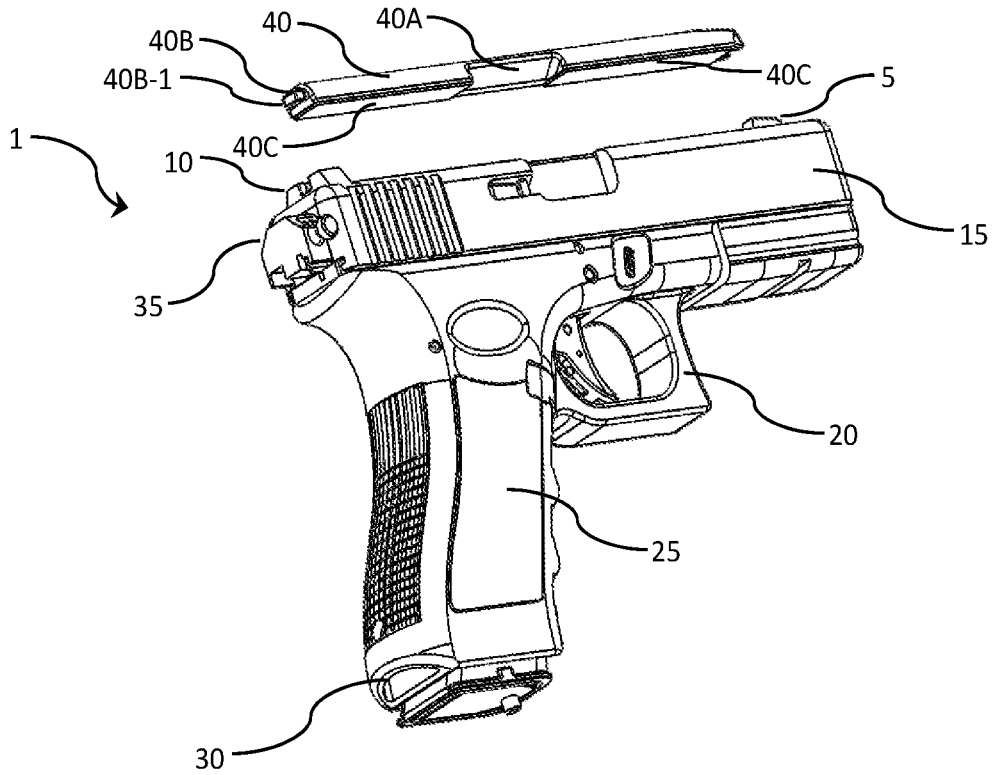
FIG. 2A depicts one embodiment of a right-bottom-rear isometric view of an improved handgun featuring an exploded view of a gunsight-augmentation member.
Figure 2B:
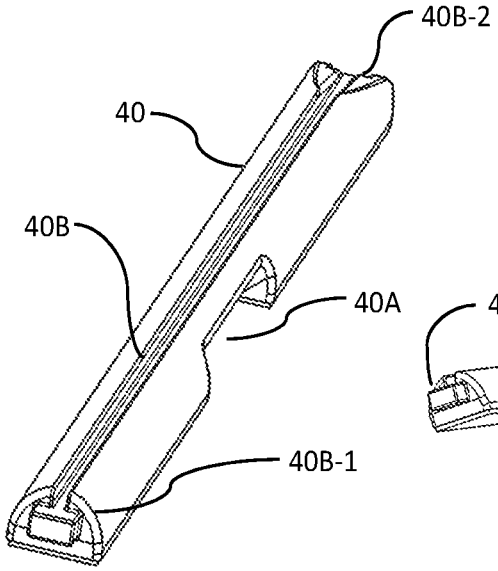
FIG. 2B depicts one embodiment of a right-top-rear isometric view of a handgun gunsight-augmentation member.
Figure 2C:
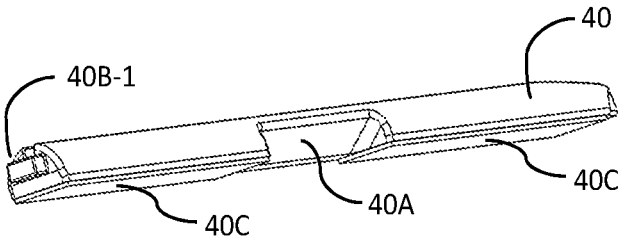
FIG. 2C depicts one embodiment of a right-bottom-rear isometric view of a handgun gunsight-augmentation member.

The inventive disclosures described herein pertain to an improved handgun (and related retrofit/after-market kits) that incorporates an improved gunsight and ergonomically enhanced pistol-grip member. In many embodiments, the improved handgun includes a gunsight-augmentation member that is adapted to be inserted between the handgun's rear and front gunsights such that the gunsight has been basically transformed into a barrel-length U-shaped channel that makes it clear to a user how to line-up a target, while ensuring that the entire length of the device has a smooth shape and edges to significantly reduce snagging when drawing the firearm. In variations, the gunsight-augmentation member includes an opening for the discharge of ammunition shells as the firearm is discharged. In other variations, the gunsight-augmentation member also incorporates a channel that receives a fiber-optic rod, wherein one end of the fiber-optic rod is visible from the rear-end of the gunsight-augmentation member via a short tunnel leading to the end of the fiber-optic rod, and wherein the gunsight-augmentation member has one or more light-gathering openings along the length of the gunsight-augmentation member. When a user is looking at the rear of the gunsight fully in-line with the gun barrel, then the end of the fiber-optic rod, which can be of just about any color (e.g., fluorescent green, red, yellow, orange, etc.), will appear illuminated, thus informing the user that the user has the gunsight/barrel fully lined-up with the user's line of sight.

In some embodiments, the improved handgun also incorporates an ergonomically enhanced finger-receiving member disposed at the bottom surface of the pistol-grip and/or magazine. The ergonomically enhanced finger-receiving member allows a user to have a more-comfortable and secure grip of a handgun, as it provides a secure position of the user's pinky (fifth digit) finger, especially for compact handguns. In addition, the ergonomically enhanced finger-receiving member, when disposed at the bottom of a handgun's magazine, helps prevent the inadvertent disengagement and loss of the handgun's magazine during use.

The above-stated improvements can be applied to many, if not most, handgun designs. However, certain handguns that employ a toggle-lock action (such as with a German Luger pistol), as opposed to a slide action employed by most semi-automatic pistols, would not be candidates for retrofitting with the above-stated gunsight-augmentation members.

II. Terminology

The terms and phrases as indicated in quotes (" ") in this Section are intended to have the meaning ascribed to them in this Terminology Section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification, drawings, and any appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" and similar phrases in various places in the specification are not necessarily all meant to refer to the same embodiment.

The term "couple" or "coupled", as used in this specification, drawings, and any appended claims, refers to either an indirect or a direct connection between the identified elements, components, or objects. Often, the manner of the coupling is related specifically to the manner in which the two coupled elements interact.

The term "removable", "removably coupled", "readily removable", "readily detachable", "detachably coupled", and similar terms, as used in this specification, drawings, and any appended claims, refer to structures that can be uncoupled from an adjoining structure with relative ease (i.e., non-destructively and without a complicated or time-consuming process) and that can also be readily reattached or coupled to the previously adjoining structure.

Directional and/or relational terms such as, but not limited to, left, right, nadir, apex, top, bottom, vertical, horizontal, back, front, lateral, proximal, and distal are relative to each other, are dependent on the specific orientation of an applicable element or article, are used accordingly to aid in the description of the various embodiments, and are not necessarily intended to be construed as limiting in this specification, drawings, and any appended claims. However, with respect to a firearm/handgun, the "distal end" is considered the discharge end of the firearm/handgun, and the "proximal end" is considered the end of the firearm/handgun closest to the user during the normal use of the firearm/handgun, and this orientation applies to any gunsight-augmentation members.

As applicable, the terms "about", "approximately", or "generally", as used herein unless otherwise indicated, means a margin of +−20%. Also, as applicable, the term "substantially" as used herein unless otherwise indicated means a margin of +−10%. It is to be appreciated that not all uses of the above terms are quantifiable such that the referenced ranges can be applied.

For the purposes of this patent application, references to a handgun's "barrel" generally also includes the gun's "muzzle" and "slide" (if the handgun is so equipped) as an overall assembly for reference purposes only. Occasionally, specific references are made to the subcomponents; e.g., the "muzzle", "slide", and/or slide cover and firing-pin assembly; to aid the reader in determining orientation of the inventive components described this specification, drawings, and any appended claims.

III. An Improved Handgun with Augmented Gunsight and Ergonomically Enhanced Pistol Grip This Section III is directed generally to an improved handgun with an augmented gunsight and ergonomically enhanced pistol grip (and related retrofit/after-market kits). Refer to FIGS. 1A through 11H.

In typical embodiments, the improved handgun 1 incorporates an improved gunsight-augmentation member 40, which is adapted to be inserted and closely fitted between the handgun's 1 rear and front gunsights 10, 5 such that the gunsight 40 has been basically transformed into a barrel-length, substantially U-shaped channel 40B (also called a longitudinal viewing channel), with a first end 40B-1 disposed toward the rear of the gunsight 10 and barrel 15 (and slide/firing-pin assembly 35, if so equipped), and with a second end 40B-2 (typically shaped like a dual-pronged fork) disposed toward the front of the gunsight 5 and barrel 15 (and slide, if so equipped) that makes it clear to a user how to line-up a target; that is giving a user an unobstructed view of the target directly in sight of the path of the projectile. In variations, the channel 40B may be substantially U-shaped, V-shaped, semi-circle-shaped, have squared angles, be enclosed in a complete circle or square, or any other shape most beneficial or practical. The size of the channel opening 40B may be made larger to aid in quick target acquisition, or may be made smaller for more accuracy.

In variations, the gunsight-augmentation member 40 includes an opening 40A for the discharge of ammunition shells as the firearm 1 is discharged. This opening 40A can be a side-disposed, funnel-shaped opening. An additional benefit of the uninterrupted length of the gunsight-augmentation member 40 with an opening 40A for the discharge of ammunition shells is that the handgun's shell-ejection port typically found on semi-automatic handguns is partially covered-up, thus guiding exhaust gases and the ejected bullet case more to the side and away from directly in line of the shooter's face. Typically, in a self-defense situation a shooter is unlikely to wear any protective gear, as they would on the shooting range.

Importantly, in most embodiments, along the entire length of the gunsight-augmentation member 40 the raised edges are finished smooth and tapered outward along the longitudinal sides, and the height of the gunsight-augmentation member 40 is equal to or very slightly higher than the handgun's 1 regular front and rear gunsights 5, 10 in order to eliminate the chance of snagging as a user draws the firearm 1 from a holster of other means of firearm carrying; that is, eliminate any protruding points or sharp edges. In addition, the height of the gunsight-augmentation member 40 ensures that a user can view a target through the entire length of the U-shaped channel without the front sight 5 impeding the view of the targeted path of the projectile.

In many embodiments, the gunsight-augmentation member 40 is substantially comprised of an injection-molded polymer. In other embodiments, various metal alloys (e.g., aluminum alloys, stainless steel, etc.) can be used so long as they are finely machined to not have sharp or jagged edges In still more embodiments, composite materials, such as carbon-fiber-reinforced plastic, can be used.

In typical embodiments, the gunsight-augmentation member's 40 first end 40B-1 is adapted to butt-up against the handgun's 1 rear gunsight 10, and in some variations, that first end 40B-1 has a slight protrusion 40B-3 adapted to fit within the notch of the rear gunsight 10. Conversely, the gunsight-augmentation member's 40 second end 40B-2 (typically shaped like a dual-pronged fork) is adapted to form a fork of sorts that tightly interfaces and covers, at least in part, both sides of the handgun's 1 front gunsight 5. The tight interface tolerances employ the firearm's 1 existing gun sights, especially after such existing gunsights 10, 5 have already been properly adjusted/sighted-in, for proper alignment in order to help ensure that the installation of the gunsight-augmentation member 40 is properly aligned to ensure the enhanced gunsight's 5, 10, 40 effectiveness. The specific dimensions required for the gunsight-augmentation member 40 is dependent upon the dimensions of the handgun 1, in particular, the length between the rear and front sights 10, 5 and the dimensions (including the height) of the rear and front sights 10, 5.

In many variations, the gunsight-augmentation member 40 is attached to the top surface of the barrel/slide 15 via threaded fasteners (not shown) through tapped holes (not shown) or other types of mechanical fasteners (e.g., rivets; not shown). In other variations, especially for retrofit/after-market kits, a heavy-duty, double-sided adhesive mounting tape 40C is used. An example of such tape that is effective for this use is 3M® VHB Heavy-Duty Mounting Tape—0.375 in. (W) Permanent Bonding Double-Sided Tape, which can be applied to a broad range of substrates. Of course, many other heavy-duty double-sided adhesive tapes can be used as well.

In other embodiments, the improved handgun 1 gunsight has the aforementioned gunsight-augmentation member 40 manufactured directly into the frame of the handgun 1; that is, into the top of the barrel/slide 15, as opposed to attaching the gunsight-augmentation member 40 after gun manufacture. When the gunsight-augmentation member 40 is part of the handgun's 1 manufacturing process, it also adds strength to the barrel (this is particularly the case for revolvers) and lessens barrel distortion from the heat generated from repeated gun discharging.

In some applications, the center opening of the gunsight-augmentation member 40 has a set of high visibility painted surfaces that help users use the improved handgun 1 in reduced-visibility conditions. The paint is preferably of an enamel type that will adhere to a variety of surfaces, fluorescent, and the colors used are different for the front and rear ends 40B-1, 40B-2 of the gunsight-augmentation member 40 sight to differentiate between the two ends.

Figure 3A:
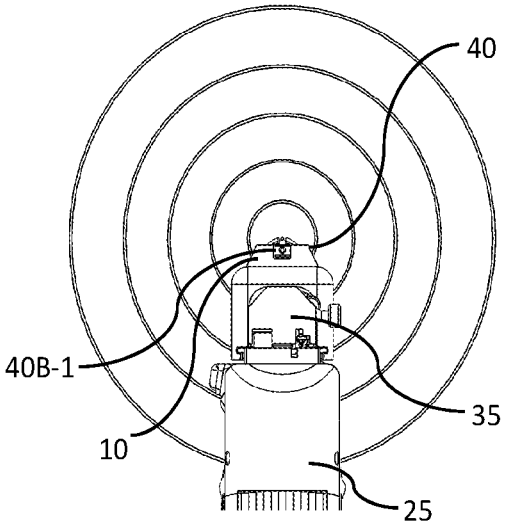
FIGS. 3A, 3B, 3C, and 3D each depict an embodiment of the rear view of an improved handgun featuring a gunsight-augmentation member being aimed at a target, with FIG. 3A showing a properly lined-up gunsight with the center of the target, and FIGS. 3B-3D showing various misalignments of the handgun's improved gunsight with respect to the target.
Figure 3B:
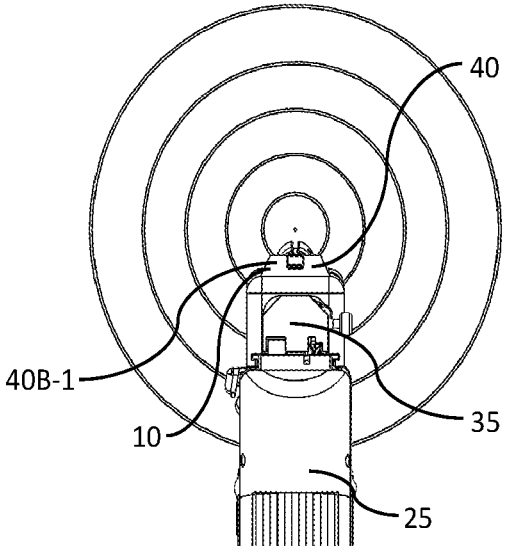
Figure 3C:
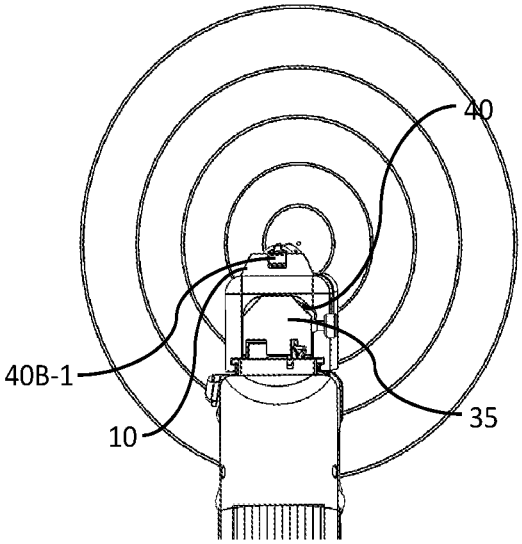
Figure 3D:
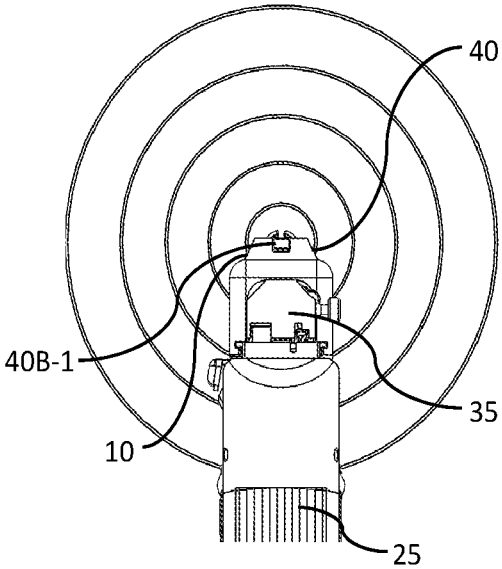
Figure 4A:
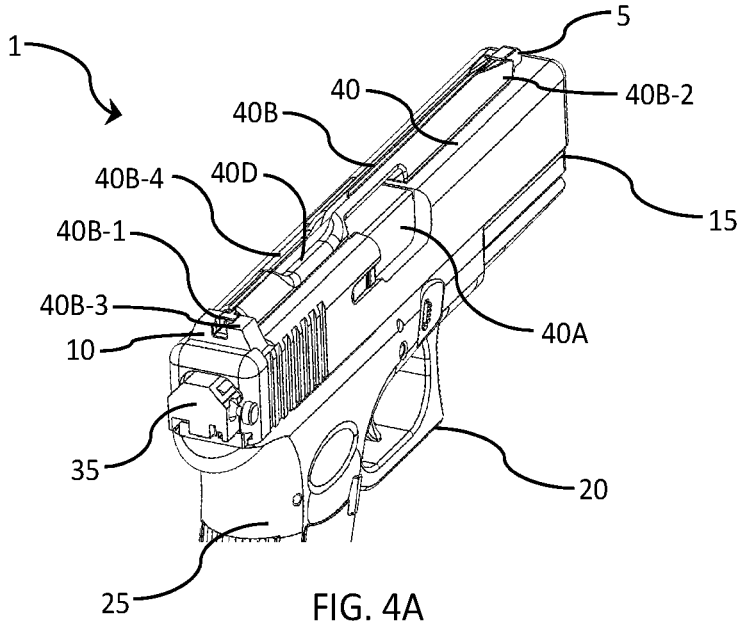
FIG. 4A depicts one embodiment of a right-top-rear isometric view of an improved handgun featuring a gunsight-augmentation member that also incorporates an optical fiber channel and related light-gathering aperture.
Figure 4B:
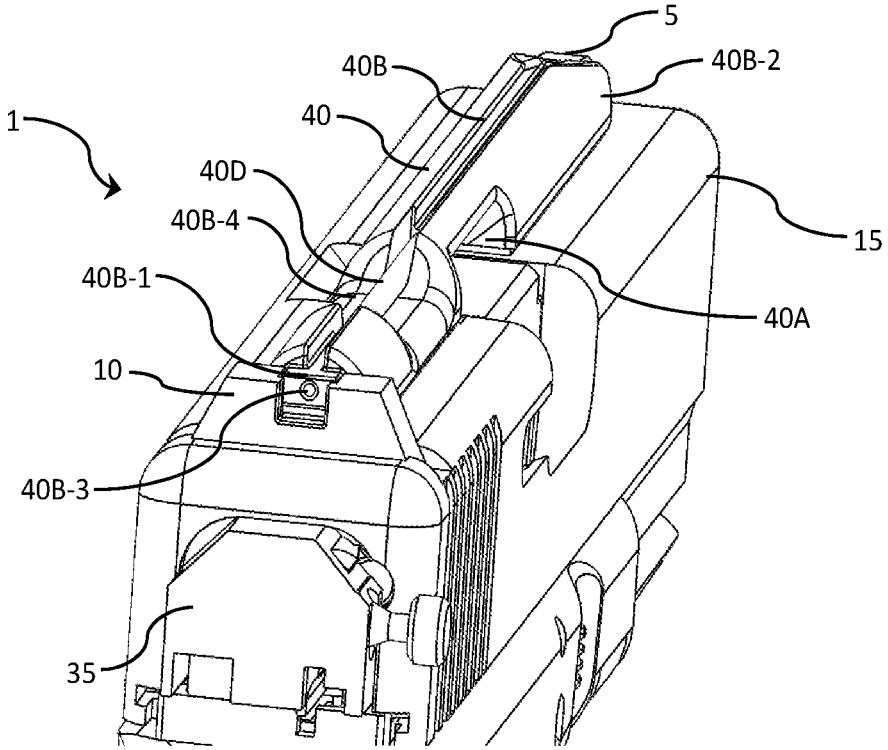
FIG. 4B depicts one embodiment of a close-up view of the right-top-rear isometric view of an improved handgun featuring a gunsight-augmentation member that also incorporates an optical fiber channel and related light-gathering aperture that is shown in FIG. 4A.
Figure 4C:
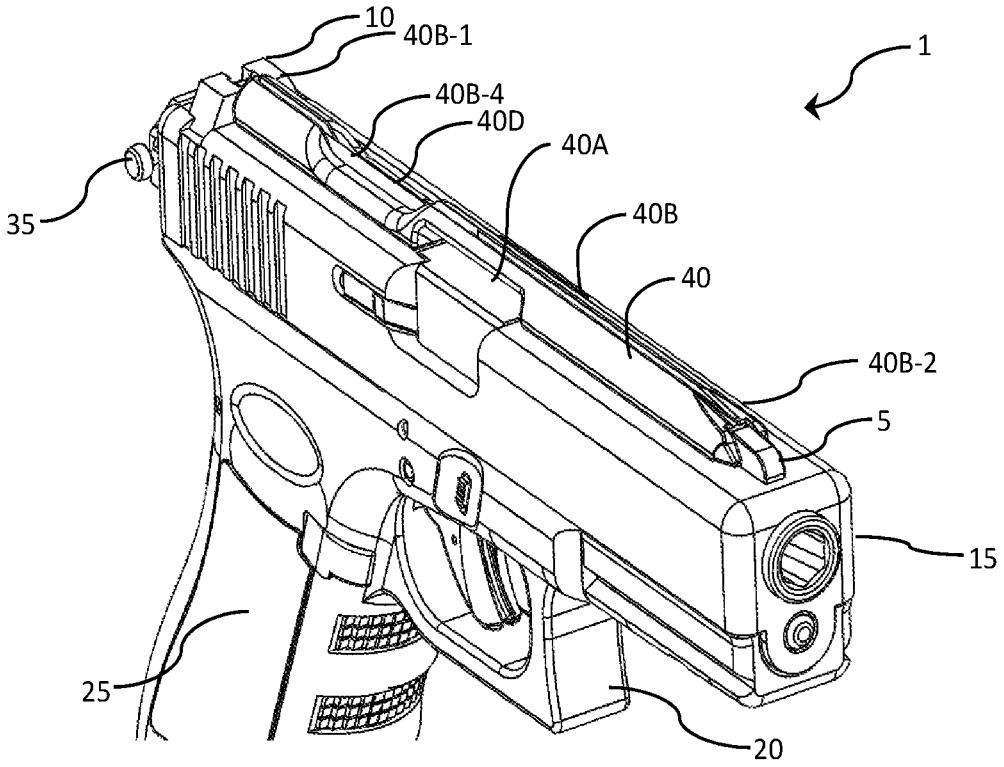
FIG. 4C depicts one embodiment of a right-top-front isometric view of an improved handgun featuring an exploded view of a gunsight-augmentation member that also incorporates an optical fiber channel and related light-gathering aperture.
Figure 5A:
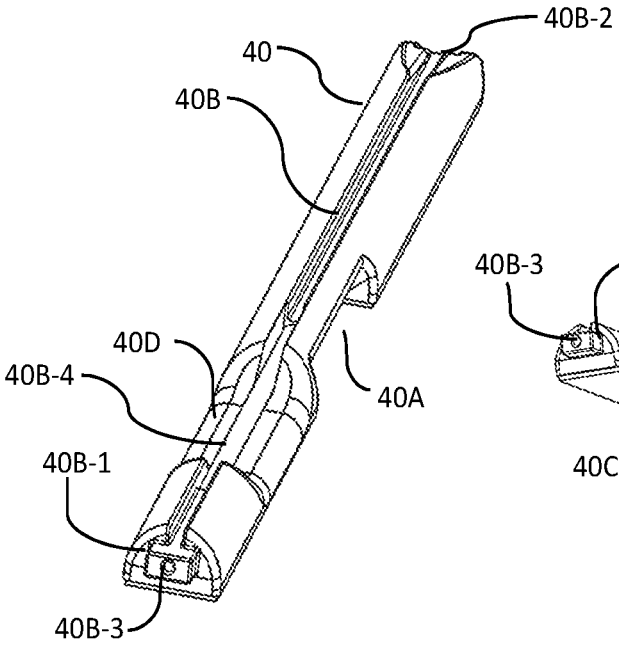
FIG. 5A depicts one embodiment of a right-top-rear isometric view of a handgun gunsight-augmentation member that also incorporates an optical fiber channel and related light-gathering aperture.
Figure 5B:
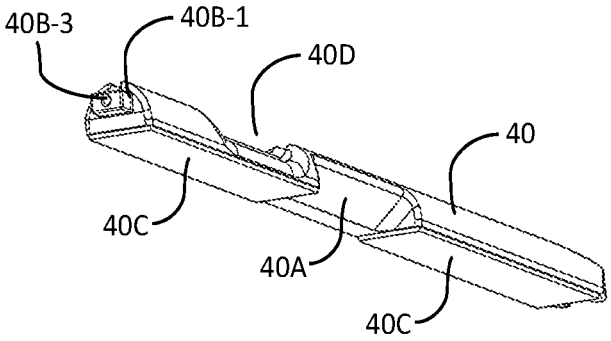
FIG. 5B depicts one embodiment of a right-bottom-rear isometric view of a handgun gunsight-augmentation member that also incorporates an optical fiber channel and related light-gathering aperture.
Figure 5C:
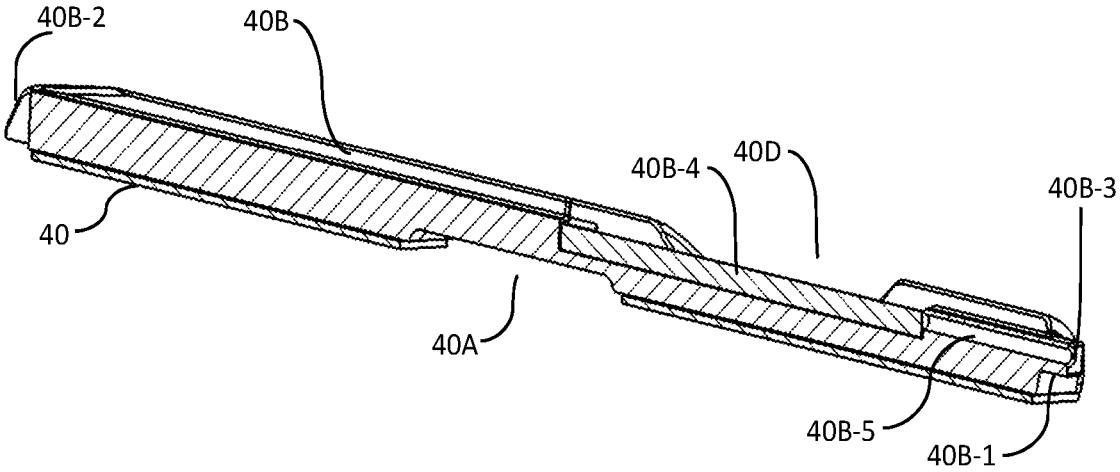
FIG. 5C depicts one embodiment of a left-rear cross-sectional isometric view of a handgun gunsight-augmentation member that also incorporates an optical fiber channel, a short "tunnel" to the end of the optical fiber, and related light-gathering aperture.
Figure 5D:
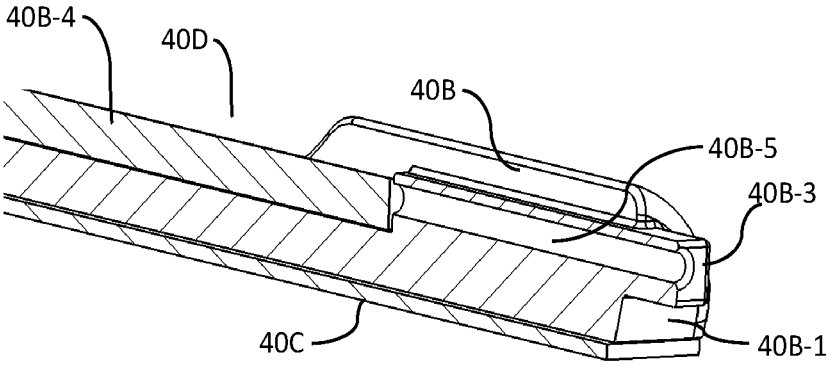
FIG. 5D depicts one embodiment of a close-up view of the left-rear cross-sectional isometric view of a proximal end of a handgun gunsight-augmentation member that also incorporates an optical fiber channel, a short "tunnel" to the end of the optical fiber, and related light-gathering aperture.
Figure 6A:
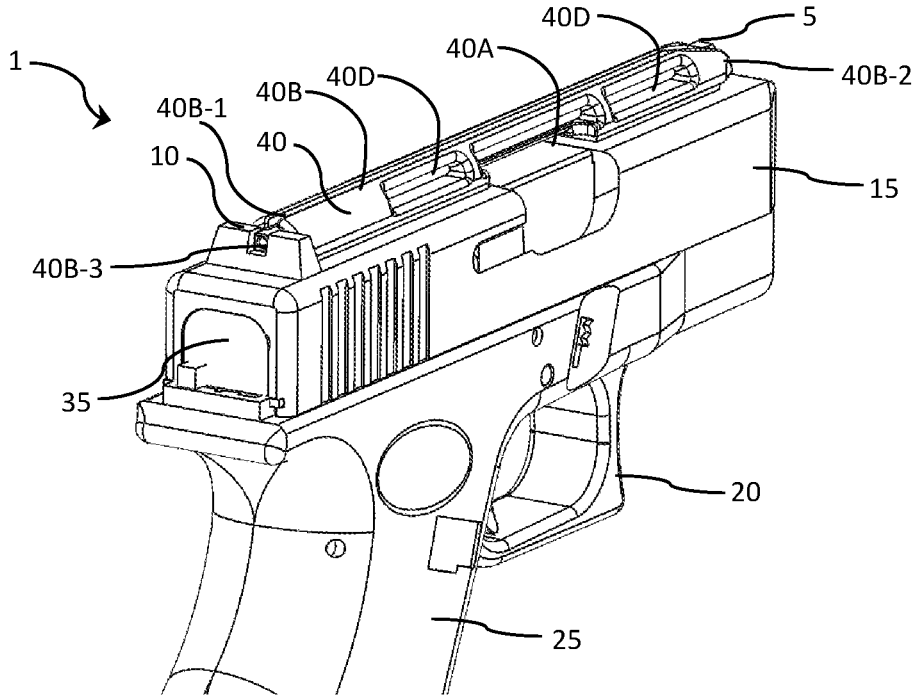
FIG. 6A depicts one embodiment of a right-top-rear isometric view of an improved handgun featuring a gunsight-augmentation member that also incorporates an optical fiber channel and a plurality of related light-gathering apertures.
Figure 6B:
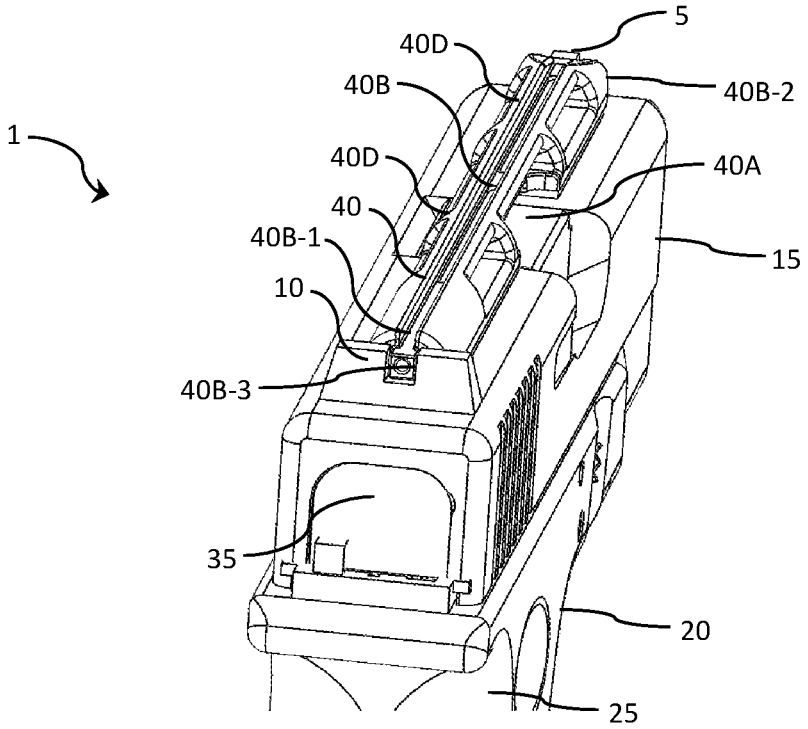
FIG. 6B depicts one embodiment of a close-up view of the right-top-rear isometric view of an improved handgun featuring a gunsight-augmentation member that also incorporates an optical fiber channel and plurality of related light-gathering apertures that is shown in FIG. 6A.
Figure 6C:
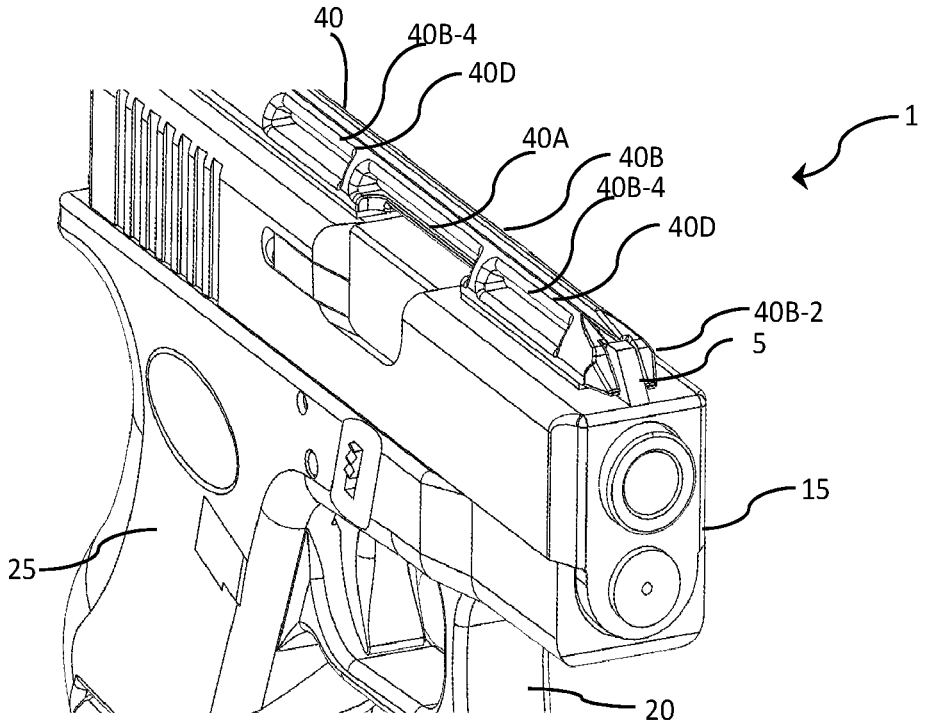
FIG. 6C depicts one embodiment of a right-top-front isometric view of an improved handgun featuring an exploded view of a gunsight-augmentation member that also incorporates an optical fiber channel and a plurality of related light-gathering apertures.
Figure 6D:
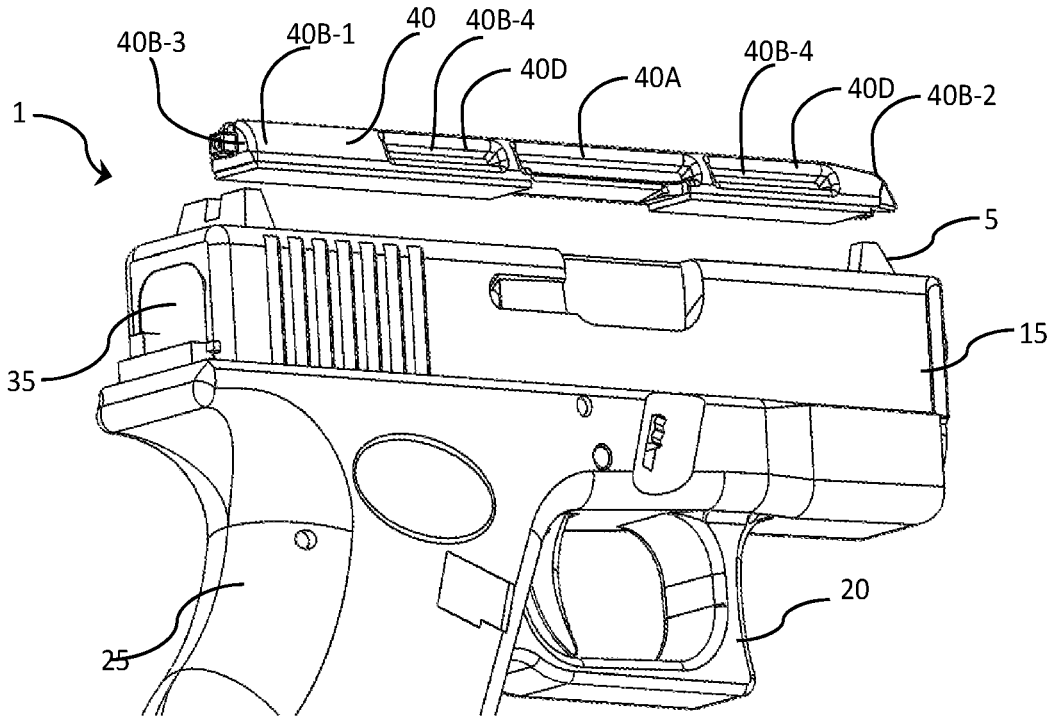
FIG. 6D depicts one embodiment of a right-bottom-rear isometric view of an improved handgun featuring an exploded view of a gunsight-augmentation member that also incorporates an optical fiber channel and a plurality of related light-gathering apertures.
Figure 7A:
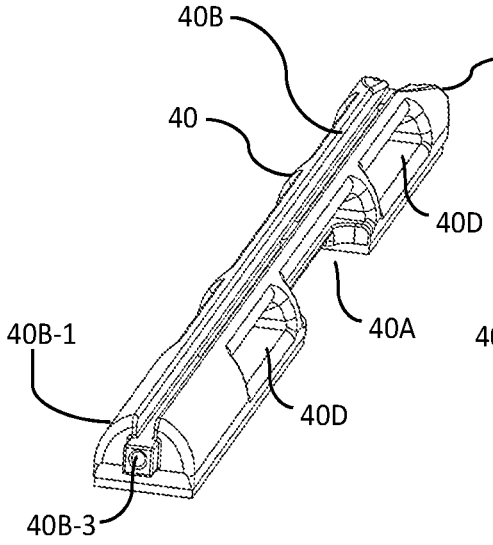
FIG. 7A depicts one embodiment of a right-top-rear isometric view of a handgun gunsight-augmentation member that also incorporates an optical fiber channel and a plurality of related light-gathering apertures.
Figure 7B:
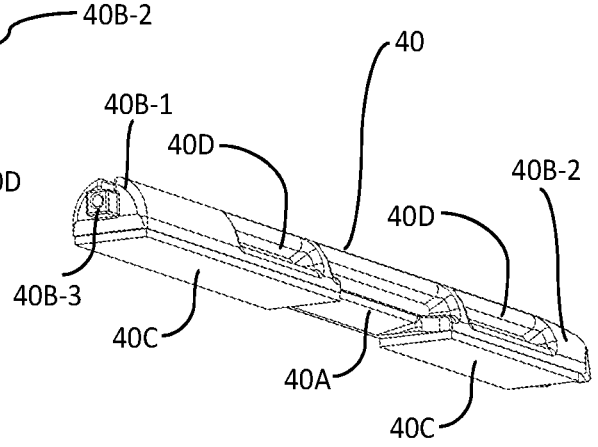
FIG. 7B depicts one embodiment of a right-bottom-rear isometric view of a handgun gunsight-augmentation member that also incorporates an optical fiber channel and a plurality of related light-gathering apertures.
Figure 7C:
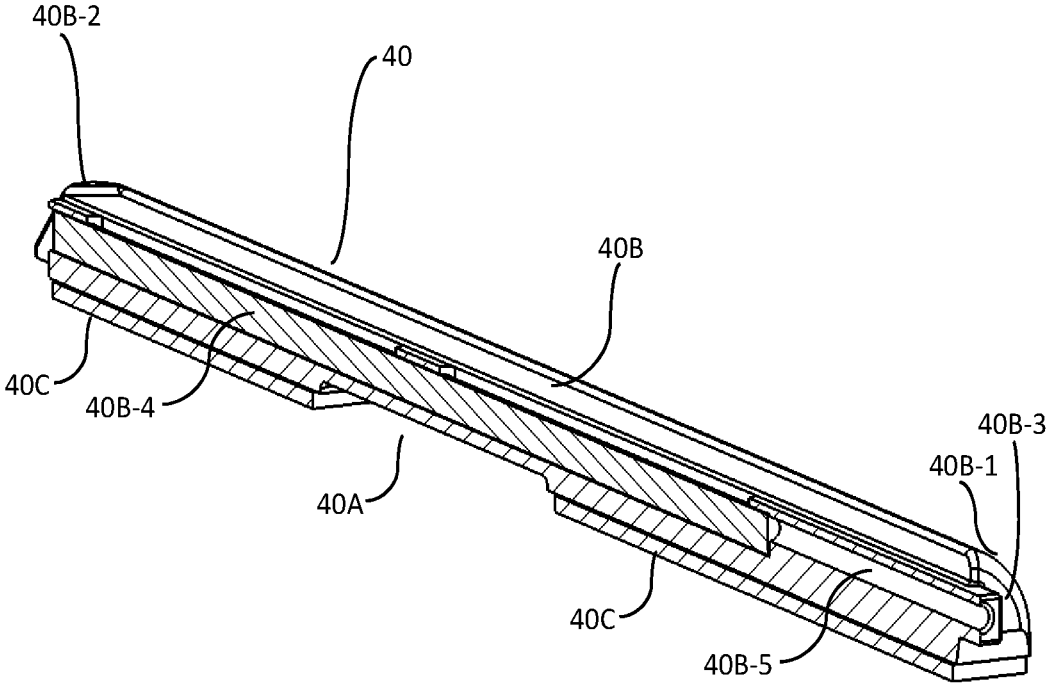
FIG. 7C depicts one embodiment of a left-rear cross-sectional isometric view of a handgun gunsight-augmentation member that also incorporates an optical fiber channel, a short "tunnel" to the end of the optical fiber, and related light-gathering aperture.

FIGS. 3A through 3D each depict an embodiment of the rear view of an improved handgun 1 featuring a gunsight-augmentation member 40 being aimed at a target, with FIG. 3A showing a properly lined-up gunsight 10, 5, 40 with the center of the target, and FIGS. 3B-3D showing various misalignments of the handgun's 1 improved gunsight 10, 5, 40 with respect to the target.

Protruding gun sights 10, 5 often are adjustable, typically at the rear sight 10, and up to the manufacturer's process how robust it is held in place, therefore it may get knocked out of alignment if the firearm is dropped. Therefore, in some embodiments, the gunsight-augmentation member 40 provides for the option of having a U-shaped channel (or other shaped channel as described above) with an incorporated fiber-optic rod 40B-4 in order to help a user identify such a problem. In such embodiments, a single fiber-optic, high visibility fiber-optic rod 40B-4 is placed in such a way as to be obvious for both novice and expert use, even in reduced-visibility conditions. At the proximal end of the gunsight-augmentation member 40 is a short "tunnel" or "peephole" 40B-5 (typically about an inch in length; however, this length can be varied in different applications) leading to the end of the fiber-optic rod 40B-4, which helps direct a user to look directly at the proximal gunsight-augmentation-member end 40B-3 of the "peephole" 40B-5 to the fiber-optic rod 40B-4 to ensure an accurate aim. If the user is either not looking straight onto the rear (proximal) end of the gunsight 10, 40, 40B-1, or if the gunsight 10, 40, 40B-1 is out of alignment with the barrel 15 when the user is aiming straight with the barrel 15, then a user will not see a relatively bright/illuminated fiber-rod 40B-4 end through the peephole 40B-5, alerting the user to the issue. This enhanced gunsight-augmentation system 40 prepares the user to be accurate and on target under various lighting conditions.

In variations, the gunsight-augmentation member 40 incorporates a channel that receives a fiber-optic rod 40B-4, wherein one end of the fiber-optic rod 40B-4 is visible via a short tunnel or "peephole" 40B-5 at the proximal end of the gunsight 10, 40 and approximately flush with the rear-end 40B-1 of the gunsight-augmentation member 40, and wherein the gunsight-augmentation member 40 has one or more light-gathering openings 40D along the length of the gunsight-augmentation member 40, or at least along the length of the fiber-optic rod 40B-4. In some cases, the one or more light-gathering openings or apertures 40D are open at the top of the gunsight-augmentation member 40, while in other cases the light-gathering openings 40D are open on at least one side of the gunsight-augmentation member 40. When a user is looking at the rear of the gunsight 10 fully in-line with the gun barrel 15, then the proximal end of the fiber-optic rod 40B-3, which can be of just about any color (e.g., fluorescent green, red, yellow, orange, etc.), will appear illuminated, thus informing the user that the user has the gunsight/barrel 15 fully lined-up with the user's line of sight.

In variations, the fiber-optic rod 40B-4 diameter, length, "peephole"/tunnel 40B-5 length, and exposed section 40D to light, and its associated orifice diameter size and length may be of any shape most beneficial or practical optimized for a variety of conditions. For example, the size of the fiber-optic rod 40B-4 diameter can made larger to gather more light via the light-gathering opening(s) 40D, and/or the fiber-optic-rod 40B-4 orifice tunnel 40B-5 diameter and/or orifice length can be made larger/longer to allow to transmit more light through. Light provided by the fiber-optic rod 40B-4 and traveling through the orifice tunnel 40B-5 is only visible when in-line with the user's vision, and quickly fades if not lined-up properly.

Figure 8A:
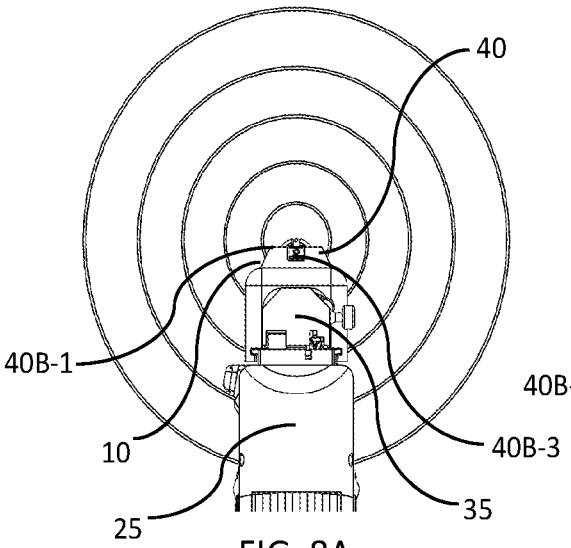
FIGS. 8A, 8B, 8C, and 8D each depict an embodiment of the rear view of an improved handgun featuring a gunsight-augmentation member that also incorporates an optical fiber channel and one or more related light-gathering apertures being aimed at a target, with FIG. 8A showing a properly lined-up gunsight with the center of the target, and FIGS. 8B-8D showing various misalignments of the handgun's improved gunsight with respect to the target.
Figure 8B:
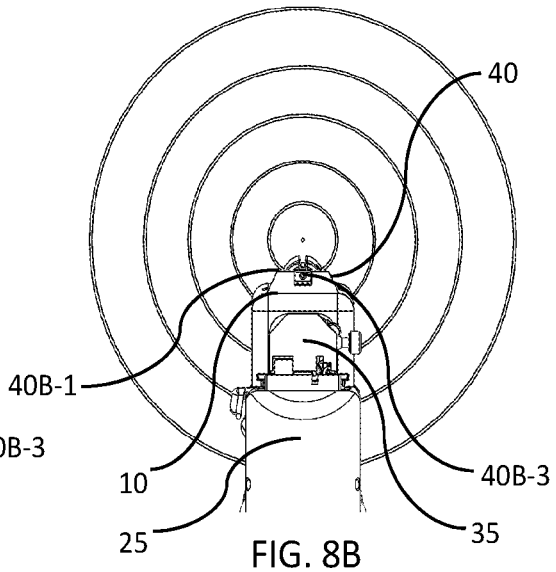
Figure 8C:
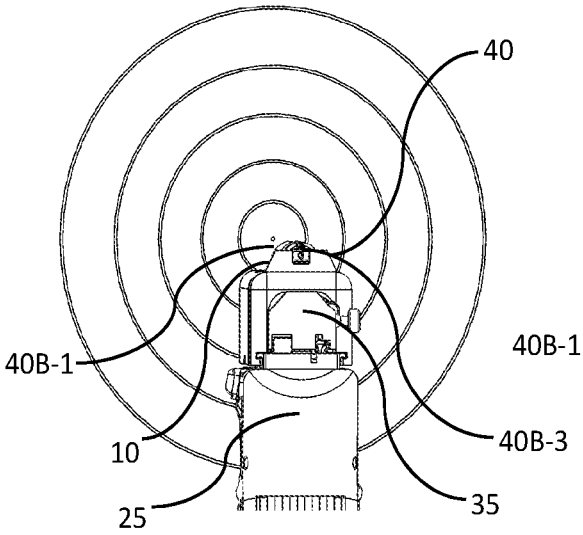
Figure 8D:
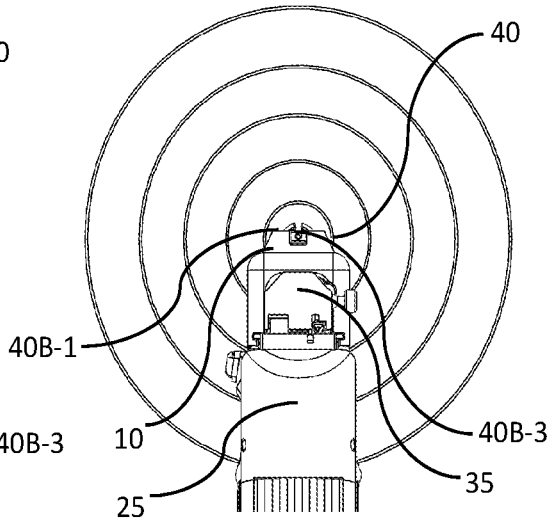
Figure 9A:
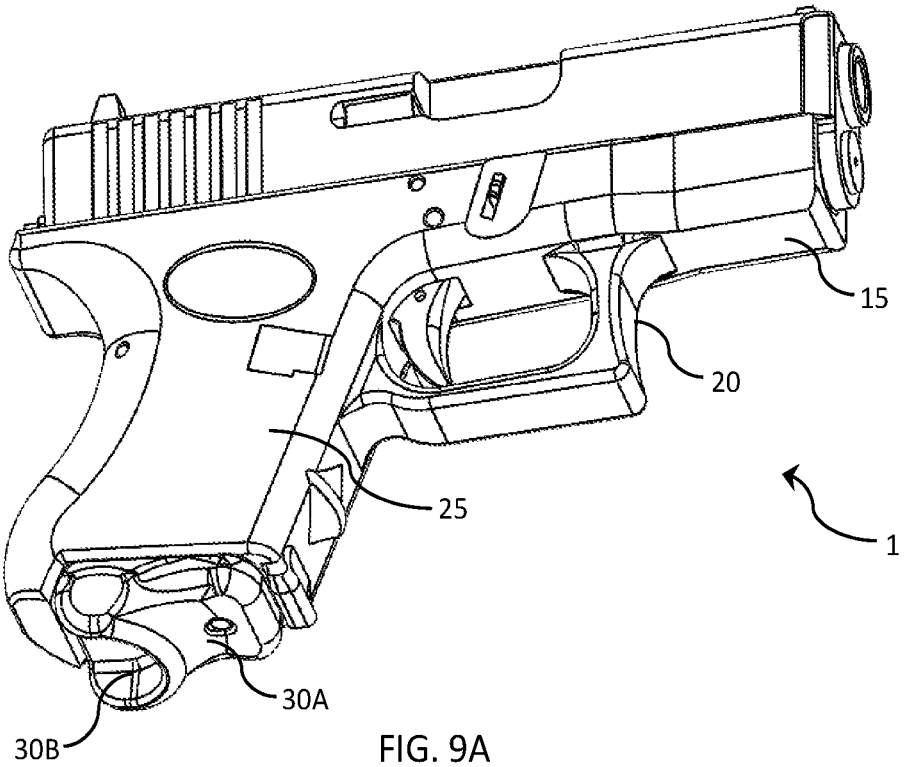
FIG. 9A depicts one embodiment of a bottom-right isometric view of an improved handgun featuring an enhanced finger-receiving pistol-grip member disposed at the bottom of the magazine cartridge.
Figure 9B:
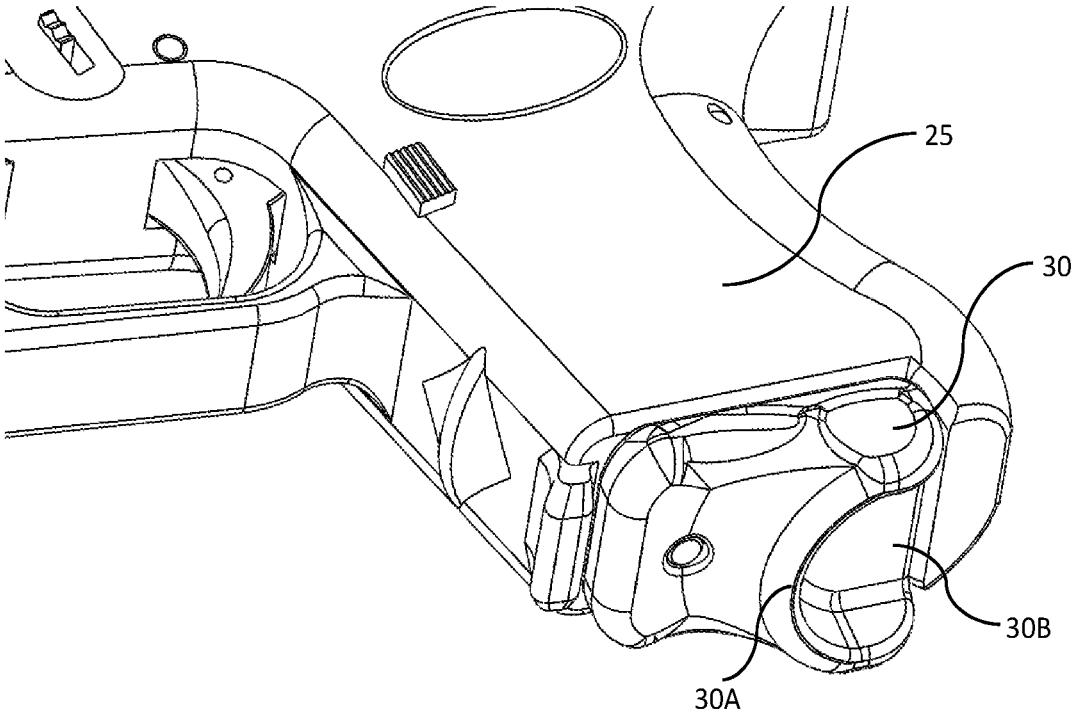
FIG. 9B depicts one embodiment of a bottom-left view of the handle of an improved handgun featuring an enhanced finger-receiving pistol-grip member disposed at the bottom of the magazine cartridge.
Figure 9C:
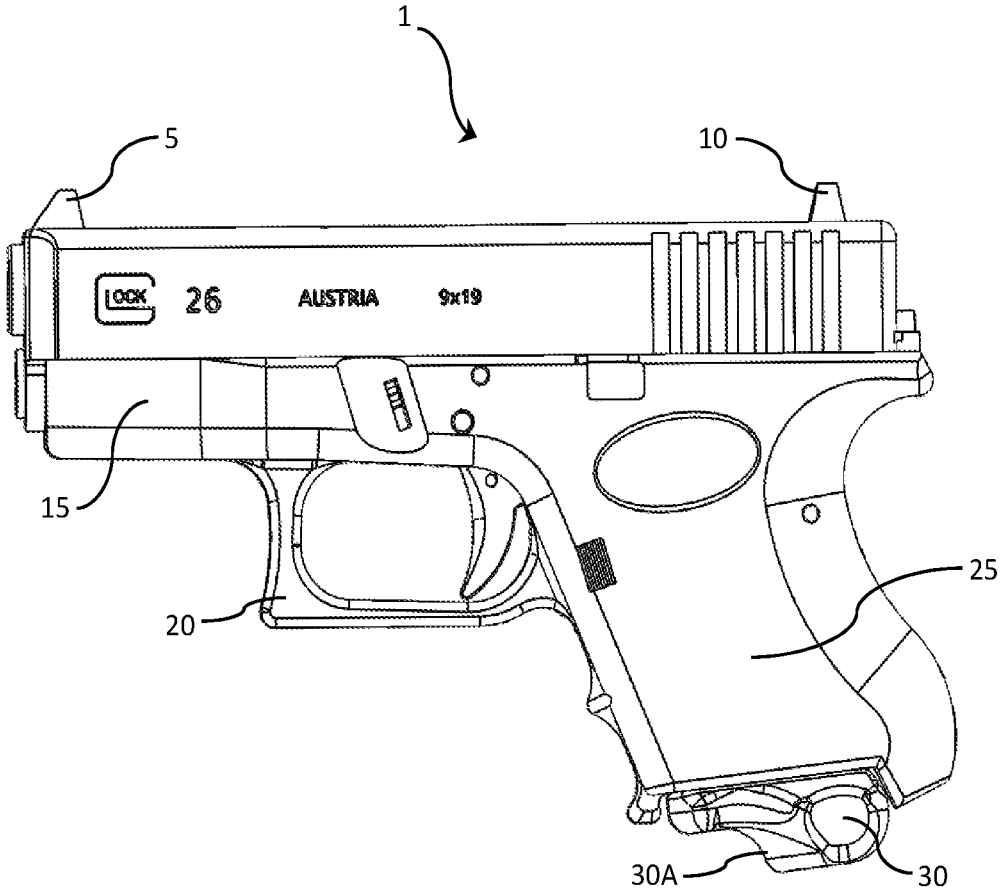
FIG. 9C depicts one embodiment of a left-side view of an improved handgun featuring and enhanced finger-receiving pistol-grip member disposed at the bottom of the magazine cartridge.
Figure 10A:
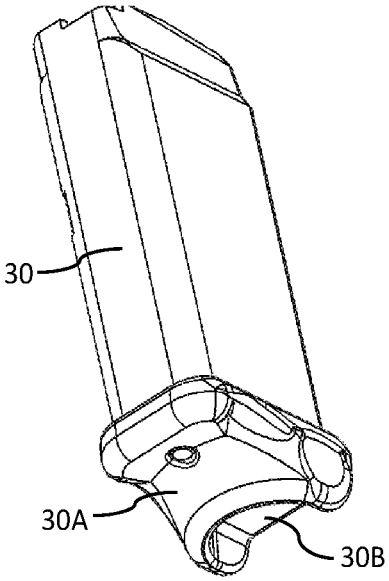
FIG. 10A depicts one embodiment of a bottom-left-front isometric view of an improved magazine cartridge for a handgun featuring an enhanced finger-receiving pistol-grip member disposed at the bottom of the magazine cartridge.
Figure 10B:
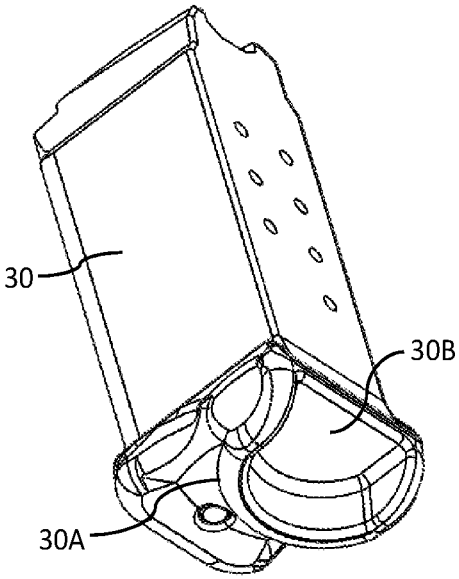
FIG. 10B depicts one embodiment of a bottom-left-rear isometric view of an improved magazine cartridge for a handgun featuring an enhanced finger-receiving pistol-grip member disposed at the bottom of the magazine cartridge.
Figure 10C:
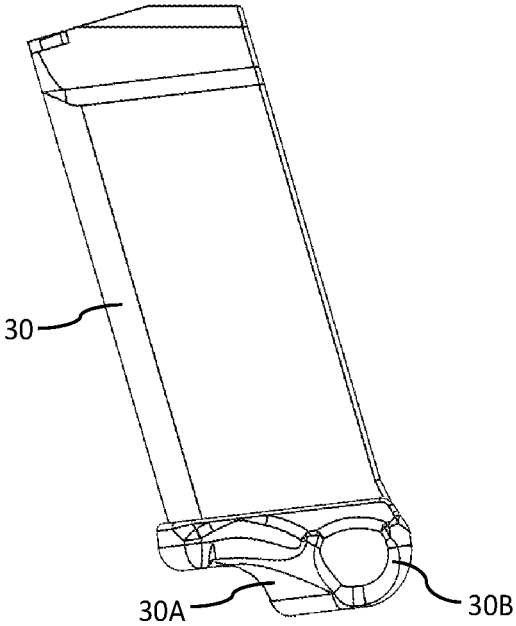
FIG. 10C depicts one embodiment of a left-side view of an improved magazine cartridge for a handgun featuring an enhanced finger-receiving pistol-grip member disposed at the bottom of the magazine cartridge.
Figure 10D:
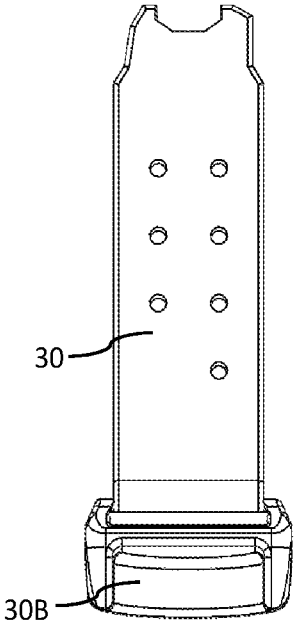
FIG. 10D depicts one embodiment of a rear view of an improved magazine cartridge for a handgun featuring an enhanced finger-receiving pistol-grip member disposed at the bottom of the magazine cartridge.
Figure 11A:
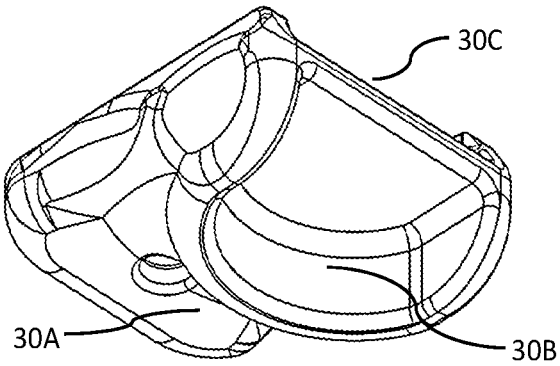
FIG. 11A depicts one embodiment of a bottom-left-rear isometric view of an enhanced finger-receiving pistol-grip member intended to be installed at the bottom of the magazine cartridge of a handgun.
Figure 11B:
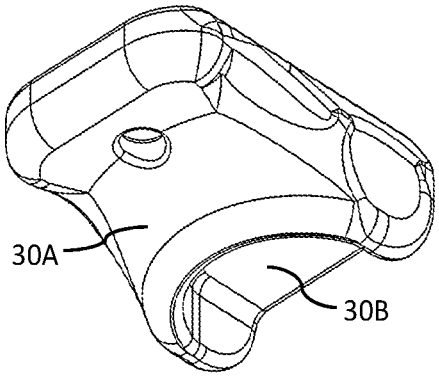
FIG. 11B depicts one embodiment of a bottom-left-front isometric view of an enhanced finger-receiving pistol-grip member intended to be installed at the bottom of the magazine cartridge of a handgun.
Figure 11C:
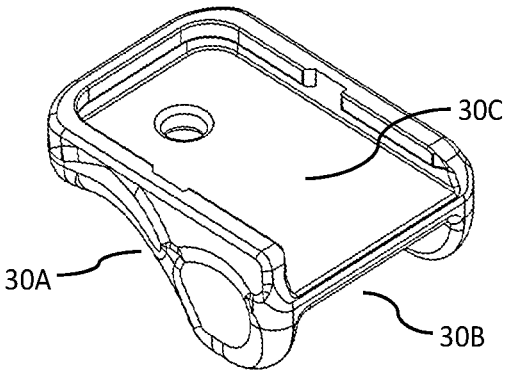
FIG. 11C depicts one embodiment of a top-left-rear isometric view of an enhanced finger-receiving pistol-grip member intended to be installed at the bottom of the magazine cartridge of a handgun.
Figure 11D:
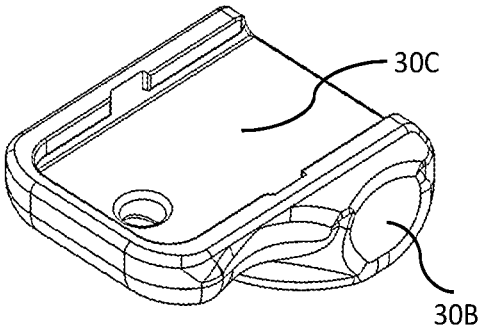
FIG. 11D depicts one embodiment of a top-left-front isometric view of an enhanced finger-receiving pistol-grip member intended to be installed at the bottom of the magazine cartridge of a handgun.
Figure 11E:
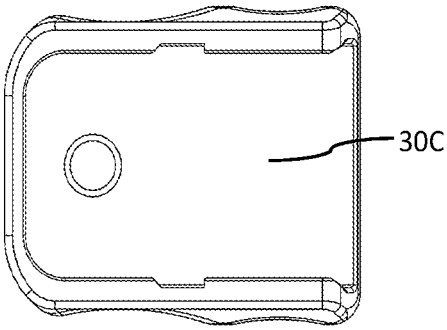
FIG. 11E depicts one embodiment of a top view of an enhanced finger-receiving pistol-grip member intended to be installed at the bottom of the magazine cartridge of a handgun.
Figure 11F:
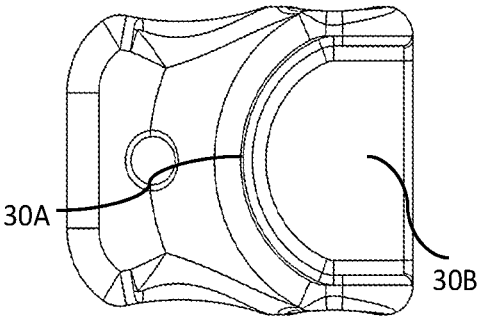
FIG. 11F depicts one embodiment of a bottom view of an enhanced finger-receiving pistol-grip member intended to be installed at the bottom of the magazine cartridge of a handgun.
Figure 11G:
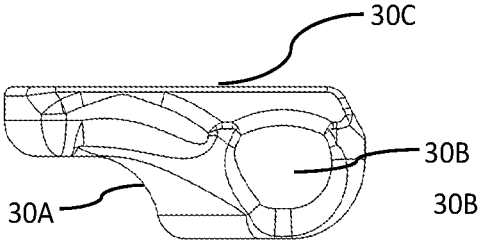
FIG. 11G depicts one embodiment of a left view of an enhanced finger-receiving pistol-grip member intended to be installed at the bottom of the magazine cartridge of a handgun.
Figure 11H:
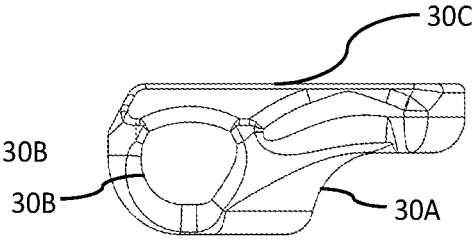
FIG. 11H depicts one embodiment of a right view of an enhanced finger-receiving pistol-grip member intended to be installed at the bottom of the magazine cartridge of a handgun.

FIGS. 8A, 8B, 8C, and 8D each depict an embodiment of the rear view of an improved handgun 1 featuring a gunsight-augmentation member 40 that also incorporates an optical-fiber channel 40B-4, an associated "peephole"/tunnel 40B-5, and one or more related light-gathering apertures 40D being aimed at a target, with FIG. 8A showing a properly lined-up gunsight 10, 5, 40 with the center of the target, and FIGS. 8B-8D showing various misalignments of the handgun's 1 improved gunsight 10, 5, 40 with respect to the target.

The above-stated improvements can be applied to many, if not most, handgun designs. However, certain handguns that employ a toggle-lock action (such as with a German Luger pistol), as opposed to a slide action employed by most semi-automatic pistols, would not be candidates for retrofitting with the above-stated gunsight-augmentation members 40.

In even more embodiments, the improved handgun 1 also incorporates an ergonomically enhanced finger-receiving member 30A disposed at the bottom surface of the pistol-grip 25 and/or magazine 30. The ergonomically enhanced finger-receiving member 30A allows a user to have a more-comfortable and secure grip of the handgun 1, as it provides a well-defined and secure position of a user's pinky (fifth digit) finger, especially for compact handguns 1. In addition, the ergonomically enhanced finger-receiving member 30A, when disposed at the bottom of a handgun's magazine 30, helps prevent the inadvertent disengagement and loss of the handgun's magazine 30 during use. By placing the pinky finger and squeezing under the magazine 30, accidental magazine 30 ejection is prevented, and holding the full weight of the handgun 1 is distributed between the pinky finger and the middle finger under the trigger shroud 20.

In variations, the bottom member 30A, 30B of the improved magazine 30 has not only the ergonomically enhanced finger-receiving member 30A, but also has on the rear side a cavity 30B that helps a user grasp the bottom of the magazine 30 with the user's thumb. In more variations, a slightly wider angled protrusion of that bottom member 30A, 30B allows for grasping and pulling out the magazine 30.

In embodiments, the bottom member 30A, 30B, 30C of the improved magazine 30 can also be adapted to be added onto other handgun pistol-grips 25 that do not use a traditional magazine, such as in the case of revolvers. Such bottom members 30A, 30B, 30C can also be added to improve existing magazines 30, typically attaching them with heavy-duty, double-sided adhesive tape. In other variations, such bottom members 30A, 30B, 30C are adapted to replace an existing removable magazine plate that is designed to have an interlocking coupling with the magazine 30. FIGS. 11A through 11H depict example embodiments of such a pistol-grip 25 bottom member 30A, 30B, 30C, with the aforementioned ergonomically enhanced finger-receiving member 30A, the aforementioned thumb-receiving cavity 30B, and an upper surface 30C that is sized and shaped to be adapted to the bottom of a pistol-grip 25 or to the bottom of an existing magazine 30.

Overall, the use of an ergonomically enhanced finger-receiving member 30A at the bottom of a pistol-grip provides several additional advantages: First, the user's pinky finger significantly helps firmly hold a handgun magazine 30 in place when shooting one-handed. Second, a user's pinky finger under a pistol-grip 25 or magazine 30 fits well in a user's opposite hand palm when compared to other types of magazine extensions. Pinky support shape positively identifies magazine orientation when changing magazines, without looking, just by feel. Pinky support reduces and better counteracts barrel rise from recoil since it's further down from barrel, thus resulting in counter-rotational torque. Combine that with left hand palm support for even better control.

In other embodiments, the above-discussed improvements for a handgun 1 are encompassed in one or more after-market/retrofit kits. Such kits may include the gunsight-augmentation member 40, the improved magazine 30 with an ergonomically enhanced finger-receiving member 30A, and/or a stand-alone pistol-grip bottom member 30A, 30B, 30C, depending on the types of handguns they are designed for.

IV. A Method of Using an Improved Handgun with an Augmented Gunsight

This Section IV is directed generally to method of using an improved handgun equipped with an augmented gunsight. Refer to FIGS. 1A through 8D.

In typical embodiments, the method comprises the steps of:

By a user, obtaining an improved handgun 1 with an augmented-gunsight member 40 according to Section III, supra;

By a user, holding the improved handgun 1 and aiming it at a user-specified target by looking through the proximal gunsight 10 and/or first-end 40B-1 of the gunsight-augmentation member 40 until the intended target appears within the channel 40B of the gunsight-augmentation member 40;

If the gunsight-augmentation member 40 is equipped with a fiber-optic rod 40B-4, then by a user, before the step of discharging said improved handgun 1, ensuring that said improved handgun 1 is properly lined-up with said user-selected target and the user's aiming eye by:

Looking through said viewing peephole 40B-5; and

Adjusting the improved handgun 1 direction as necessary until both the user-selected target is lined-up with said longitudinal channel 40B and the end of said fiber-optic rod 40B-4 appears as illuminated; and By a user, squeezing the handgun's trigger 20 to discharge the handgun 1.

V. A Method of Using an Improved Handgun With an Enhanced Pistol Grip

This Section V is directed generally to method of using an improved handgun with an enhanced pistol-grip. Refer to FIGS. 9A through 11H.

In typical embodiments, the method comprises the steps of:

By a user, obtaining an improved handgun 1 with an enhanced pistol grip 30, 30A, 30B according to Section III, supra;

By a user, holding the improved handgun 1 with the user's pinky finger on the hand holding the improved firearm 1 disposed against the ergonomically enhanced finger-receiving member 30A; and By a user, squeezing the handgun's trigger 20 to discharge the handgun 1.

If the improved handgun 1 is equipped with a magazine 30 disposed within the pistol-grip 25, the method further comprises the steps of:

By a user, releasing the magazine 30 from the pistol-grip 25 and grasping the bottom of the magazine 30 using the thumb-receiving member 30B; and By a user, reloading the magazine 30 as necessary, then grasping the bottom of the magazine 30 using the thumb-receiving member 30B and reinserting the magazine 30 into the pistol-grip 25.

VI. A Method of Using an Kit to Retrofit a Handgun With an Augmented Gunsight

This Section VI is directed generally to method of using a kit to retrofit a handgun with an augmented gunsight. Refer to FIGS. 1A through 8D.

In typical embodiments, the method comprises the steps of:

By a user, obtaining an augmented-gunsight member 40 that is sized for the user-specified firearm 1 according to Section III, supra; and By a user, fixedly attaching 40C said augmented-gunsight member 40 to the top of the handgun's barrel/slide 15, between the front and rear gunsights 5, 10.

VII. A Method of Using an Kit to Retrofit a Handgun with an Enhanced Pistol Grip This Section VII is directed generally to method of using a kit to retrofit a handgun with an enhanced pistol grip. Refer to FIGS. 9A through 11D.

In typical embodiments, the method comprises the steps of:

By a user, if the handgun 1 has a magazine 30 disposed within the pistol-grip member 25, then either:

Obtaining an improved magazine 30 with an ergonomically enhanced finger-receiving member 30A according to Section III, supra, then replacing the existing magazine 30 with the improved magazine 30; or Obtaining a new pistol-grip 25 bottom member 30A, 30B, 30C according to Section III, supra, then attaching it with heavy-duty, double-sided adhesive tape to the bottom of the existing magazine 30;

By a user, if the handgun 1 does not have a magazine 30 disposed within the pistol-grip member 25, then obtaining a new pistol-grip 25 bottom member 30A, 30B, 30C according to Section III, supra, then attaching it with heavy-duty, double-sided adhesive tape to the bottom of the pistol-grip member 25.

VIII. Alternative Embodiments and Other Variations

The various embodiments and variations thereof described herein, including the descriptions in any appended Claims and/or illustrated in the accompanying Figures, are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising myriad obvious variations and improvements to the invention, all of which are intended to be encompassed within the scope of the Description, Figures, and Claims herein.

What is claimed is:

1. An improved handgun, comprising:

a front gunsight disposed on the distal end of said handgun, relative to a user of said handgun;

a rear gunsight disposed on the proximal end of said handgun, relative to a user of said handgun, having two vertical prongs with a space disposed between them;

an elongated gunsight-augmentation member having a first end and a second end, and having raised longitudinal edges, wherein:

said gunsight-augmentation member is disposed on the top surface of said handgun, between said front and rear gunsights, said gunsight-augmentation member's base length is substantially equal to the distance between said front and rear gunsights, and said gunsight-augmentation member has a longitudinal viewing channel disposed in the top of said gunsight-augmentation member and spans the entire length of said gunsight-augmentation member.

2. The improved handgun of claim 1, wherein said gunsight-augmentation member's second end is adapted to form a dual-pronged fork that tightly interfaces with both sides of said front gunsight.

3. The improved handgun of claim 1, wherein said gunsight-augmentation member's first end is adapted to fit within said space between said vertical prongs of said rear gunsight.

4. The improved handgun of claim 1, wherein the cross-sectional view of said longitudinal viewing channel, as viewed directly from an end of said longitudinal viewing channel, is of a shape that is selected from the group consisting of U-shape, V-shape, semi-circle-shape, and U-shape with squared angles.

5. The improved handgun of claim 1, wherein said longitudinal viewing channel is completely enclosed and its cross-sectional view of said longitudinal viewing channel, as viewed directly from an end of said longitudinal viewing channel, is of a shape that is selected from the group consisting of circle, square, and rectangle.

6. The improved handgun of claim 1, wherein:

said handgun is equipped with a slide with a shell-ejection port; and said gunsight-augmentation member has an opening positioned to accommodate the ejection of ammunition shells as said handgun is discharged.

7. The improved handgun of claim 1, wherein:

the raised edges of said gunsight-augmentation member are finished smooth and tapered outward along the longitudinal sides of said gunsight-augmentation member; and said the height of gunsight-augmentation member is equal to or higher than said handgun's front and rear gunsights in order to eliminate snag points for said handgun's front and rear gunsights.

8. The improved handgun of claim 1, wherein said gunsight-augmentation member is substantially comprised of material selected from the group consisting of an injection-molded polymer, metal alloy, aluminum alloy, stainless steel, carbon-fiber-reinforced plastic, and a combination of any of the aforementioned materials.

9. The improved handgun of claim 1, wherein said gunsight-augmentation member is secured to the top surface of said handgun using a method selected from the group consisting of threaded fasteners and associated tapped holes, heavy-duty adhesive, and heady-duty double-sided adhesive tape.

10. The improved handgun of claim 1, wherein:

said handgun has a barrel or slide;

and said gunsight-augmentation member is manufactured directly on the top surface of said handgun's barrel or slide.

11. The improved handgun of claim 1, wherein said gunsight-augmentation member's first end and second end have high-visibility painted surfaces.

12. The improved handgun of claim 11, wherein:

said high-visibility paint is of an enamel type and is fluorescent; and the paint colors on said first and second ends of said gunsight-augmentation member are different.

13. The improved handgun of claim 1, further comprising:

a fiber-optic rod disposed within or below said longitudinal viewing channel of said gunsight-augmentation member;

at least one light-gathering aperture in said gunsight-augmentation member that exposes said fiber-optic rod to the ambient light around said handgun;

a viewing peephole from said first end of said gunsight-augmentation member leading to the proximal end of said fiber-optic rod; and wherein said proximal end of said fiber-optic rod can only appears illuminated by said ambient light to said user of said handgun when a user looks directly into said viewing peephole.

14. The improved handgun of claim 13, wherein said fiber-optic rod is of a fluorescent color.

15. The improved handgun of claim 1, further comprising:

a pistol-grip member; and a bottom member of said pistol-grip member, wherein said bottom member has an ergonomically enhanced finger-receiving member adapted to receive a user's pinky finger.

16. The improved handgun of claim 1, further comprising:

a pistol-grip member;

a magazine disposed within said pistol-grip member; and a bottom member of said pistol-grip member, wherein said bottom member has an ergonomically enhanced finger-receiving member adapted to receive a user's pinky finger.

17. The improved handgun of claim 1, further comprising:

a pistol-grip member;

a magazine disposed within said pistol-grip member; and a bottom member of said magazine, wherein:

said bottom member has an ergonomically enhanced finger-receiving member adapted to receive a user's pinky finger, said bottom member has a thumb-receiving member adapted to receive a user's thumb to help grip and remove said magazine, and said ergonomically enhanced finger-receiving member is positioned such that when a user grasps said handgun with said pinky finger disposed on said ergonomically enhanced finger-receiving member, additional upward support is provided on said magazine.

18. A method of using an improved hand gun according to claim 17, comprising the steps of:

by a user, obtaining an improved handgun according to either of claim 17;

by said user, holding said improved handgun with the user's pinky finger on the hand holding the improved firearm disposed against the ergonomically enhanced finger-receiving member; and by said user, squeezing said improved handgun's trigger to discharge said improved handgun.

19. The method of claim 18, further comprising the steps of:

by said user, releasing the magazine from the pistol-grip and grasping the bottom of the magazine using the thumb-receiving member; and by said user, reloading the magazine as necessary, then grasping said bottom member of the magazine using said thumb-receiving member and reinserting the magazine into the pistol-grip.

20. A method of using an improved hand gun according to claim 1, comprising the steps of:

by a user, obtaining an improved handgun according to claim 1;

by said user, aiming a user-selected target by looking through said improved handgun's gunsight-augmentation member longitudinal viewing channel;

by said user, squeezing said improved handgun's trigger to discharge said improved handgun.

21. The method of claim 20, wherein said improved handgun further comprises:

a fiber-optic rod disposed within or below said longitudinal viewing channel of said gunsight-augmentation member;

at least one light-gathering apertures in said gunsight-augmentation member that exposes said fiber-optic rod to the ambient light around said handgun;

a viewing peephole from said first end of said gunsight-augmentation member leading to the proximal end of said fiber-optic rod; and wherein said proximal end of said fiber-optic rod can only appears illuminated by ambient light to said user of said handgun when said user looks directly into said viewing peephole;

the method further comprising the steps of:

by said user, before the step of discharging said improved handgun, ensuring that said improved handgun is properly lined-up with said user-selected target and said user's aiming eye by:

looking through said viewing peephole; and adjusting the improved handgun direction as necessary until both a user-selected target is lined-up with said longitudinal viewing channel and the end of said fiber-optic rod appears as illuminated.

22. The method of claim 21, wherein said fiber-optic rod is of a fluorescent color.

23. A gunsight-augmentation device for attachment to a handgun, said handgun having a front gunsight and a rear gunsight having two vertical prongs with a space disposed between them, comprising:

an elongated gunsight-augmentation member having a first end and a second end, and having raised longitudinal edges, wherein:

said gunsight-augmentation member is adapted to be attached to the top surface of a handgun, between said front or distal end of a handgun and rear or proximal end of a handgun gunsights, said gunsight-augmentation member's base length is substantially equal to the distance between said front and rear gunsights, and said gunsight-augmentation member has a longitudinal viewing channel disposed in the top of said gunsight-augmentation member and spans the entire length of said gunsight-augmentation member.

24. The gunsight-augmentation device of claim 23, wherein said gunsight-augmentation member's second end has a dual-pronged fork that tightly interfaces with both sides of said front gunsight.

25. The gunsight-augmentation device of claim 23, wherein said gunsight-augmentation member's first end is sized to fit within said space between said vertical prongs of said rear gunsight.

26. The gunsight-augmentation device of claim 23, wherein the cross-sectional view of said longitudinal viewing channel, as viewed directly from an end of said longitudinal viewing channel, is of a shape that is selected from the group consisting of U-shape, V-shape, semi-circle-shape, and U-shape with squared angles.

27. The gunsight-augmentation device of claim 23, wherein said longitudinal viewing channel is completely enclosed and its cross-sectional view of said longitudinal viewing channel, as viewed directly from an end of said longitudinal viewing channel, is of a shape that is selected from the group consisting of circle, square, and rectangle.

28. The gunsight-augmentation device of claim 23, wherein said gunsight-augmentation member has an opening positioned to accommodate the ejection of ammunition shells.

29. The gunsight-augmentation device of claim 23, wherein the raised edges of said gunsight-augmentation member are finished smooth and tapered outward along the longitudinal sides of said gunsight-augmentation member in order to eliminate snag points for a handgun on which said gunsight-augmentation member is installed.

30. The gunsight-augmentation device of claim 23, wherein said gunsight-augmentation member is substantially comprised of material selected from the group consisting of an injection-molded polymer, metal alloy, aluminum alloy, stainless steel, carbon-fiber-reinforced plastic, and a combination of any of the aforementioned materials.

31. The gunsight-augmentation device of claim 23, wherein said gunsight-augmentation member is adapted to be secured to the top surface of a handgun using a method selected from the group consisting of threaded fasteners and associated tapped holes, heavy-duty adhesive, and heady-duty double-sided adhesive tape.

32. The gunsight-augmentation device of claim 23, wherein said gunsight-augmentation member's first end and second end have high-visibility painted surfaces.

33. The gunsight-augmentation device of claim 32, wherein:

said high-visibility paint is of an enamel type and is fluorescent; and the paint colors on said first and second ends of said gunsight-augmentation member are different.

34. The gunsight-augmentation device of claim 23, further comprising:

a fiber-optic rod disposed within or below said longitudinal viewing channel of said gunsight-augmentation member;

at least one light-gathering aperture in said gunsight-augmentation member that exposes said fiber-optic rod to the ambient light around said handgun;

a viewing peephole from said first end of said gunsight-augmentation member leading to the proximal end of said fiber-optic rod; and wherein said proximal end of said fiber-optic rod can only appears illuminated by said ambient light to said user of said handgun when a user looks directly into said viewing peephole.

35. The gunsight-augmentation member of claim 34, wherein said fiber-optic rod is of a fluorescent color.

36. A method of using an improved gunsight-augmentation member according to claim 34, comprising the steps of:

by a user, obtaining an improved gunsight-augmentation member according to claim 34 that is sized to install on a user-selected handgun, between said handgun's existing front and rear gunsights such that the height of said gunsight-augmentation member is equal to or higher than said user-selected handgun's existing front and rear gunsights in order to eliminate snag points for said handgun's front and rear gunsights;

by said user, installing said improved gunsight-augmentation member between said handgun's existing front and rear gunsights.

37. A method of using an improved gunsight-augmentation member according to claim 23, comprising the steps of:

by a user, obtaining an improved gunsight-augmentation member according to claim 23 that is sized to install on a user-selected handgun, between said handgun's existing front and rear gunsights such that the height of said gunsight-augmentation member is equal to or higher than said user-selected handgun's existing front and rear gunsights in order to eliminate snag points for said handgun's front and rear gunsights;

by said user, installing said improved gunsight-augmentation member between said handgun's existing front and rear gunsights.

* * * * *